US010252844B2

(12) United States Patent
McPherson

(10) Patent No.: US 10,252,844 B2
(45) Date of Patent: Apr. 9, 2019

(54) TAMPER-EVIDENT CLOSURE

(71) Applicant: Obrist Closures Switzerland GmbH, Reinach (CH)

(72) Inventor: Alexander Donald Meiklem McPherson, Central Scotland (GB)

(73) Assignee: Obrist Closures Switzerland GmbH, Reinach (CH)

( * ) Notice: Subject to any disclaimer, the term of this patent is extended or adjusted under 35 U.S.C. 154(b) by 554 days.

(21) Appl. No.: 14/784,728

(22) PCT Filed: Apr. 14, 2014

(86) PCT No.: PCT/EP2014/057551
§ 371 (c)(1),
(2) Date: Oct. 15, 2015

(87) PCT Pub. No.: WO2014/170286
PCT Pub. Date: Oct. 23, 2014

(65) Prior Publication Data

US 2016/0060007 A1 Mar. 3, 2016

(30) Foreign Application Priority Data

Apr. 18, 2013 (GB) ..... 1307034.7

(51) Int. Cl.
*B65D 39/00* (2006.01)
*B65D 41/28* (2006.01)
*B65D 55/02* (2006.01)

(52) U.S. Cl.
CPC ..... *B65D 55/022* (2013.01); *B65D 39/0011* (2013.01); *B65D 41/28* (2013.01); *B65D 55/026* (2013.01); *B65D 2101/0023* (2013.01)

(58) Field of Classification Search
CPC ..... B65D 55/089; B65D 41/3414; B65D 4/34191; B65D 41/3423; B65D 41/62; B65D 2101/0076
See application file for complete search history.

(56) References Cited

U.S. PATENT DOCUMENTS 4,401,226 A * 8/1983 Brown ..... B65D 51/1683 215/250
5,738,231 A 4/1998 Montgomery
(Continued)

FOREIGN PATENT DOCUMENTS

DE 2614538 A1 10/1977
EP 1659073 A1 5/2006
(Continued)

OTHER PUBLICATIONS

Intellectual Property Office of Great Britain, Search Report Issued in Patent Application No. GB1307034.7, dated Jun. 25, 2013, South Wales, 4 pages.
(Continued)

*Primary Examiner* — Andrew T Kirsch
(74) *Attorney, Agent, or Firm* — McCoy Russell LLP

(57) ABSTRACT

A tamper-evident closure for a container. The closure comprises a first portion including inner and outer parts, and a second portion. The outer part is rotatable relative to the inner part from a first position in which at least part of the first and second portions are adjacent each other to a second position in which there is a gap therebetween. The first portion comprises a locking mechanism for irreversibly locking the closure in the second position upon first opening so that the gap cannot be closed, in which the first portion comprises a compressible stopper for sealing the second portion and/or the container. A tamper-evident closure in combination with a container.

18 Claims, 6 Drawing Sheets

(56) References Cited

U.S. PATENT DOCUMENTS

| | | | | |
|---|---|---|---|---|
| 6,908,013 | B2 * | 6/2005 | Thomson | B65D 41/62 215/251 |
| 2009/0032488 | A1 | 2/2009 | Beckmann et al. | |
| 2011/0259844 | A1 | 10/2011 | Skelton et al. | |
| 2012/0279940 | A1 | 11/2012 | Giovannini et al. | |

FOREIGN PATENT DOCUMENTS

| | | | |
|---|---|---|---|
| GB | 2244048 | A | 11/1991 |
| WO | 02096771 | A1 | 12/2002 |
| WO | 2005049443 | A1 | 6/2005 |
| WO | 2006117505 | A1 | 11/2006 |
| WO | 2011086407 | A2 | 7/2011 |

OTHER PUBLICATIONS

ISA European Patent Office, International Search Report and Written Opinion Issued in Application No. PCT/EP2014/057551, dated Sep. 8, 2014, WIPO, 9 pages.
English Translation of Office Action Issued in Japan Patent Application No. 2016-508122, dated Jan. 31, 2018, 5 pages.

* cited by examiner

TAMPER-EVIDENT CLOSURE

CROSS REFERENCE TO RELATED APPLICATIONS

The present application is a U.S. National Phase of International Patent Application Serial No. PCT/EP2014/057551, entitled "TAMPER-EVIDENT CLOSURE," filed on Apr. 14, 2014, which claims priority to Great Britain Patent Application No. 1307034.7, filed on Apr. 18, 2013, the entire contents of each of which are hereby incorporated by reference for all purposes.

FIELD OF THE INVENTION

The present invention relates generally to a closure for a container and particularly to a closure with means for indicating that a closure has been opened at least once.

BACKGROUND OF THE INVENTION

There is an increasing demand for tamper-indicating systems which ensure that a container is not re-filled with non-original contents. Whilst it is relatively easy to produce some form of tamper-evidence, it is much more difficult to provide tamper-evidence which cannot be either overcome without causing the tamper-evidence system to activate, or activate and then return to a virtually visually identical state so as to appear non-activated.

A particularly useful method of providing tamper-evidence is to use a system in which a closure is initially located in a first position, but once removed can only be returned to a second position which is visually distinct from the first.

U.S. Pat. No. 5,738,231 describes a closure with a part which is moved during the opening process so that following opening it cannot pass back over projection on a container finish. The result is that the closure can only return to position which is axially displaced with respect to its original position.

WO 02/096771 describes a closure in which two parts are initially adjacent each other and during the opening process the structure of the closure is changed so that a gap is generated between the two parts as a visual indication that the closure has been opened at least once.

WO 2005/049443 and WO 2006/117505 also describe closures which generate a gap to indicate they have been opened at least once. In this case the gap is unobstructed. In other words, two parts of the closure are held apart without the requirement an obstruction.

Such tamper-evident systems are only effective if they cannot be reversed. For example, in systems which use an obstructing member to hold two parts apart it is possible to cut the obstruction member to allow a gap to be closed. WO 2005/049443 and WO 2006/117505 describe closures which generate unobstructed gaps following relative rotation of one part with respect to another. The closures are provided with some internal mechanism for preventing the two parts from being rotated back to their original relative positions. For example, ratchet arrangements present on the side walls of the parts can be used to prevent unwanted rotation. Such "lateral" ratchet arrangements have been found to be defeatable if sufficient reverse turning torque is applied.

An additional requirement for some closures is to provide a seal to preserve the contents of an associated container.

SUMMARY OF THE INVENTION

According to the present invention there is provided a tamper-evident closure for a container, the closure comprising: a first portion including inner and outer parts; and a second portion; the outer part is rotatable relative to the inner part from a first position in which at least part of the first and second portions are adjacent each other to a second position in which there is a gap therebetween, the first portion comprises locking means for irreversibly locking the closure in the second position upon first opening so that the gap cannot be closed, in which the first portion comprises a compressible stopper for sealing the second portion and/or the container.

By combining gap generator closure with a compressible stopper an improved seal can be provided.

The stopper may be formed, for example, from natural and/or synthetic material such as cork and/or a synthetic cork-like material.

The inner part may include a line of weakness which breaks if the outer part is reverse rotated relative to the inner part.

The line of weakness may consist of a plurality of frangible bridges.

The line of weakness may transversely split the inner part.

The inner part and/or outer part may include a top plate and part of the locking means may be carried on or by the plate/s.

The locking means may comprise or include a ratchet arrangement.

The second portion may incorporate a pourer.

The closure may further comprise an outer shell.

The stopper may extend through the second portion and into the bore of a container neck.

The stopper may depend from a top region of the first portion.

The first portion may include a top plate region and the stopper depends and/or extends from and/or through the region.

The stopper may extend into the inner and/or outer part of the first portion.

In one embodiment both inner and outer parts of a first portion have respective top plates which include corresponding ratchet parts that engage to prevent relative rotation of the parts. This type of ratchet arrangement may be referred to as a longitudinal ratchet arrangement, as opposed to known lateral arrangements which are positioned on side walls.

The second portion may be adapted to be connected to a container and the first portion may comprise a cap. Certain industries demand closures with a first portion comprising a cap and a second portion comprising a sleeve which is connected to a container; for example the spirits industry.

The closure may further comprise a fitment such as a non-return fitment, for example a ball and float. Alternatively the first portion may be adapted to engage a fitment associated with the container. Certain industries, in particular the spirits industry, demand additional measures to prevent tampering. In-bore fitments, such as non-return fitments, are often fitted to containers to prevent re-filling regardless of other tamper-proofing measures.

The closure may include means for preventing the inner part from moving relative to the second portion until it has reached the second position.

The gap may be unobstructed. This means that the closure would not have to rely on an obstructing member becoming trapped. By forming an unobstructed gap it is not possible to defeat the tamper-evidence by a simple cutting operation. The gap may be formed at the respective adjacent peripheries of the portions. The inner part may include a section which extends beyond the outer part towards the second portion in the second position; the part may be positioned so as to be visible through the gap.

The second portion may be permanently fixed in its position on the container. This can be used to prevent the second portion from being moved to close the gap.

The first portion may further include a lateral ratchet arrangement for locking the inner and outer parts in the second position. This provides increased resistance to re-setting.

The first portion may include engagement formations and the lateral ratchet arrangement is located above the formations. The first portion may include formations, such as screw threads, for engaging the container or in-bore fitment. In such cases the ratchet arrangement or other locking mechanism may be located above the formations so as to increase the difficulty in accessing and tampering with the locking arrangement.

Different aspects of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

BRIEF DESCRIPTION OF THE DRAWINGS

The present invention will now be more particularly described, by way of example, with reference to the accompanying drawings, in which.

DESCRIPTION

In FIGS. 1 to 8 a gap generation principle is first described. The principle is applicable to the present invention although it will be appreciated that incorporation of a compressible stopper feature would be required in order to form part of the present invention.

Figure 2:
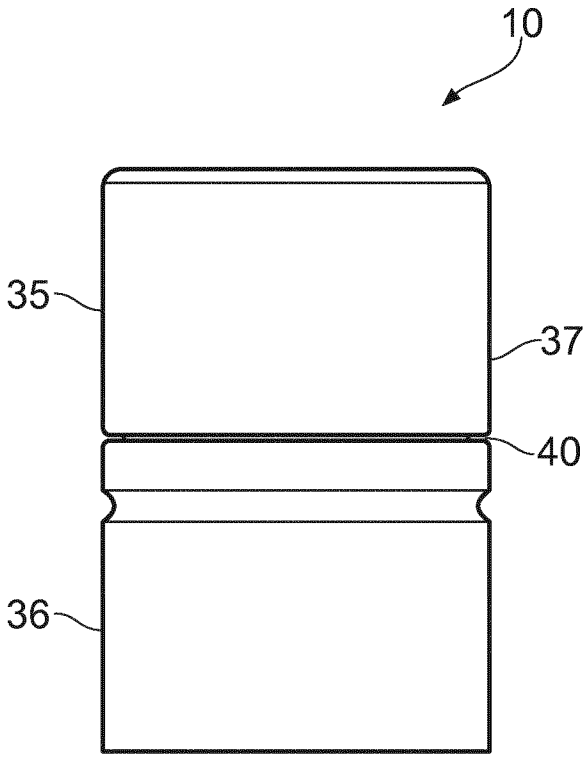
FIG. 2 is a side elevation of the closure of FIG. 1 shown prior to attachment to a container neck.
Figure 1:
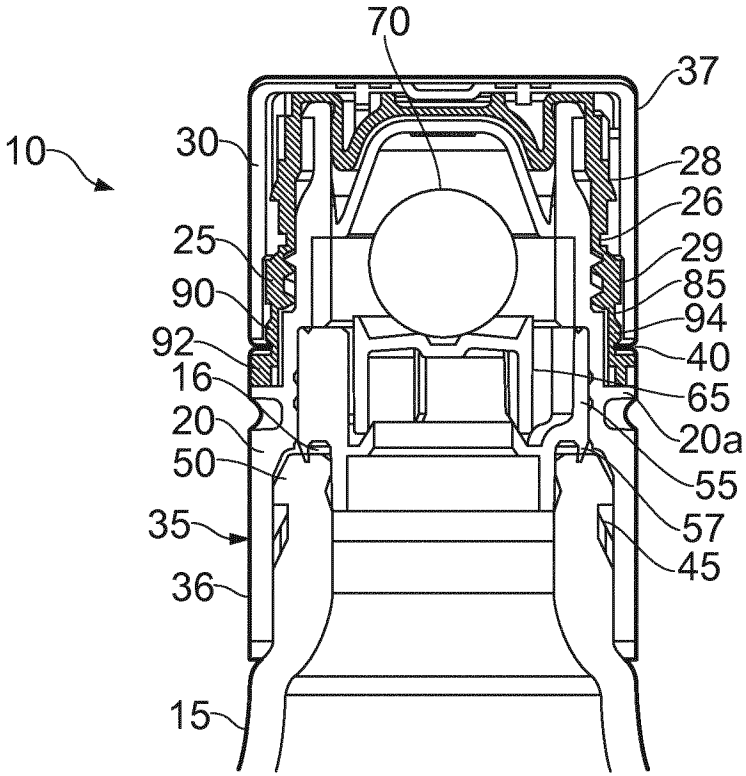
FIG. 1 is a section of a closure formed according to the present invention in a first, unopened position and shown attached to a container neck.
Figure 4:
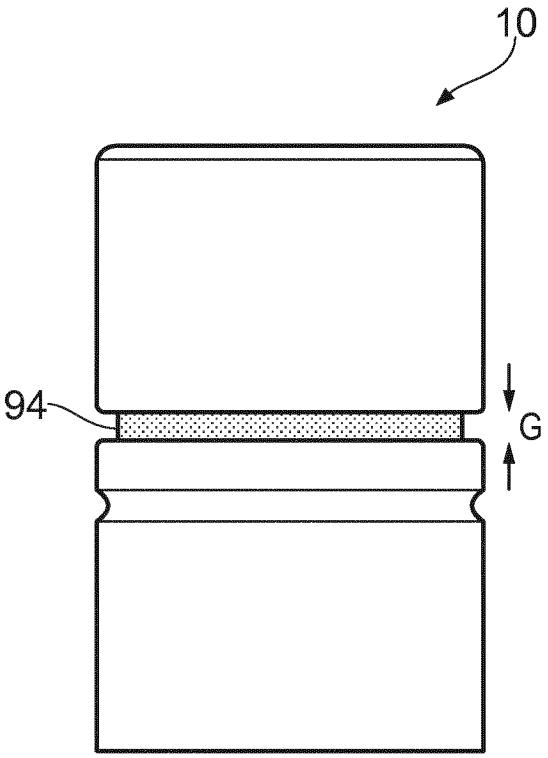
FIG. 4 shows the closure of FIG. 2 after a first opening stage.
Figure 3:
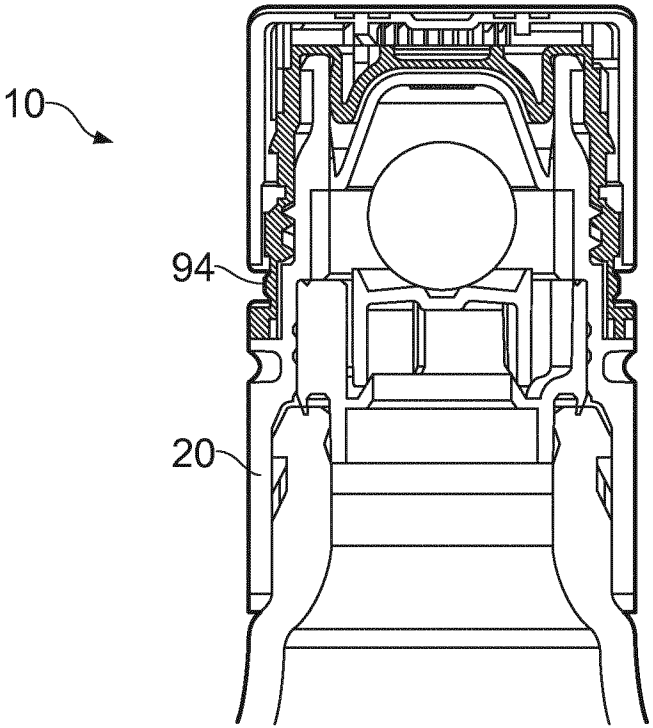
FIG. 3 shows the closure of FIG. 1 after a first opening stage.

Referring first to FIGS. 1 and 2 there is shown a closure generally indicated 10. In FIG. 1 the closure 10 is shown secured onto a container neck 15. The structure and arrangement is similar to that described in WO2009/010722.

The closure 10 comprises a main pourer body 20, an inner part 25 and an outer part 30. A metal shell 35 forms an outer casing to the closure and is divided into a cylindrical lower part 36 and a cup-shape second part 37. The parts 36, 37 are separated at a split line 40 formed by a cutting process once the shell 35 has been applied to the first and second portions of the closure.

Together the body 20 and the shell part 36 comprise a second portion and the inner and outer parts plus the shell part 37 comprises a cap-like first portion.

In this embodiment the upper and lower shell parts 36, 37 are initially joined along the split line 40 by a plurality of frangible bridges which will break if either: i) the lower shell part 36 is rotated before initial opening; or ii) an attempt is made to pull the top part of the closure off without unscrewing.

The inner part 25 of the closure extends beyond the split line 40 and the open end of the outer part to provide a dog-leg shape terminal portion 90 which rests on a shoulder 20*a* on the main body 20 so that one half 92 of the terminal portion fits beneath the upper end of the lower shell part 36 and the other half 94 fits in the upper shell part 37. Above the shell split line 40 a plurality of frangible bridges (not shown) are formed in the inner part 25 to form a split line 85.

The inner part 25 also has a line of weakness 26 provided approximately half way along its side skirt formed by a plurality of frangible bridges 27. This divides the part into a first portion 28 and a second portion 29.

The main body 20 is fixed onto the container neck 15 by clips 45 which project inwardly and engage under a shoulder 50.

A valve housing 55 is clipped into the main body 20 and includes a sealing lip 57 which seals against the top surface 16 of the container neck 15.

A float valve 65 is housed in the housing 55 and can seal against a valve seat 60 to prevent re-filling of the container. A valve control ball 70 is located on top of the float valve 65.

In normal operation the second part 37 of the shell 35 is rotated anti-clockwise and the unscrewing action breaks the bridges on the split line 40.

The outer part unscrews together with the second part 37 whilst the inner part remains held on the main body. The unscrewing continues to the position shown in FIGS. 3 and 4 until a ratchet locking mechanism locks the outer part to the inner part 25.

Figure 5:
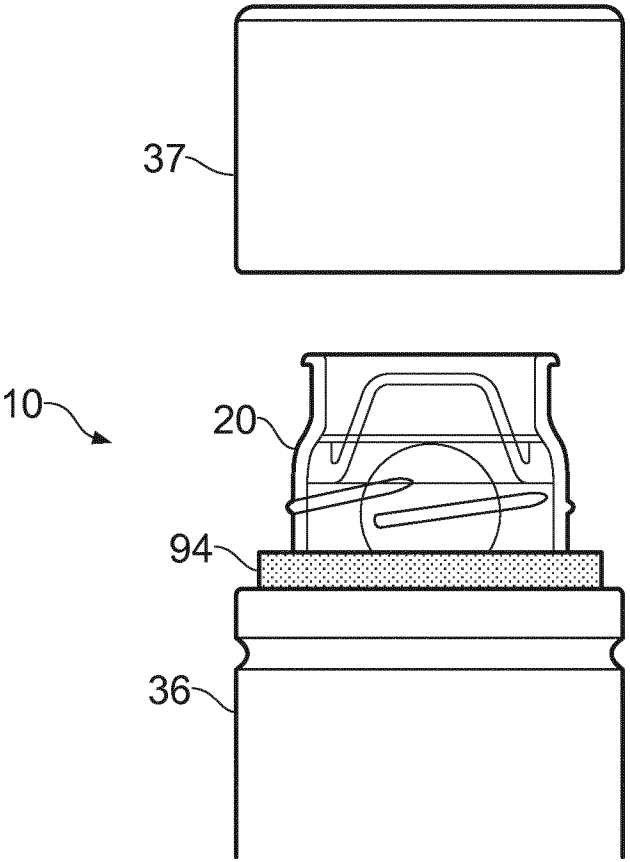
FIG. 5 shows the closure of FIG. 4 after a second opening stage.

With the outer and inner parts locked together the inner part 25 can then be unscrewed from the main body 20. Because the terminal portion 92 is held under the shell part 36, when the inner part rotates it breaks along the split line 85. The result is that the terminal portion 90 of the inner part remains held on the body so that the half 94 produces a visible upstanding band as shown in FIG. 5.

Figure 6:
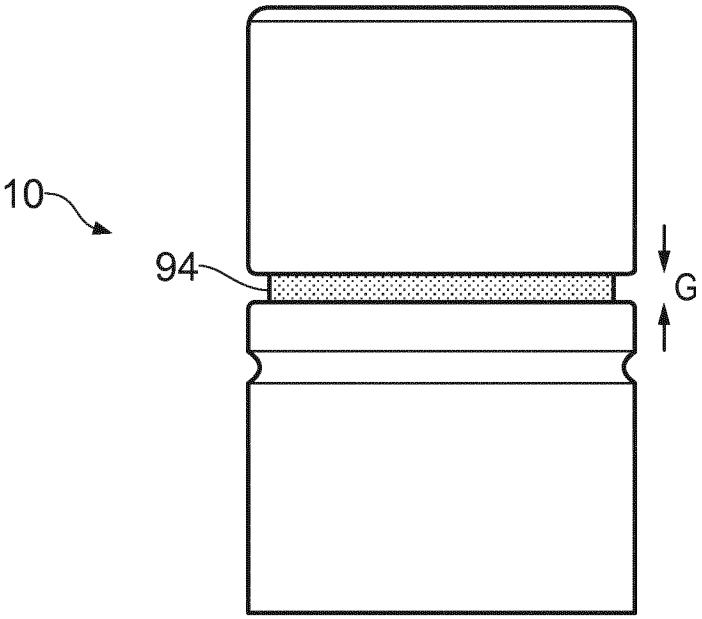
FIG. 6 shows the closure of FIG. 5 after a top cap has been re-fitted.

When the cap (shell part 37, outer part 30, inner part 25) is screwed back onto the main body 20, a gap G is formed between the first and second shell parts 36, 37. This is because the outer part 30 cannot be screwed completely back down onto the inner part 25 by virtue of the locking mechanism. In addition, the band 94 of the inner part 25 projects above the shell part 36 so as to be visible in the gap G as shown in FIG. 6.

The gap G formed between the shell parts 36, 37 is unobstructed in the sense that there is no obstruction member trapped between the parts 36, 37.

Figure 8:
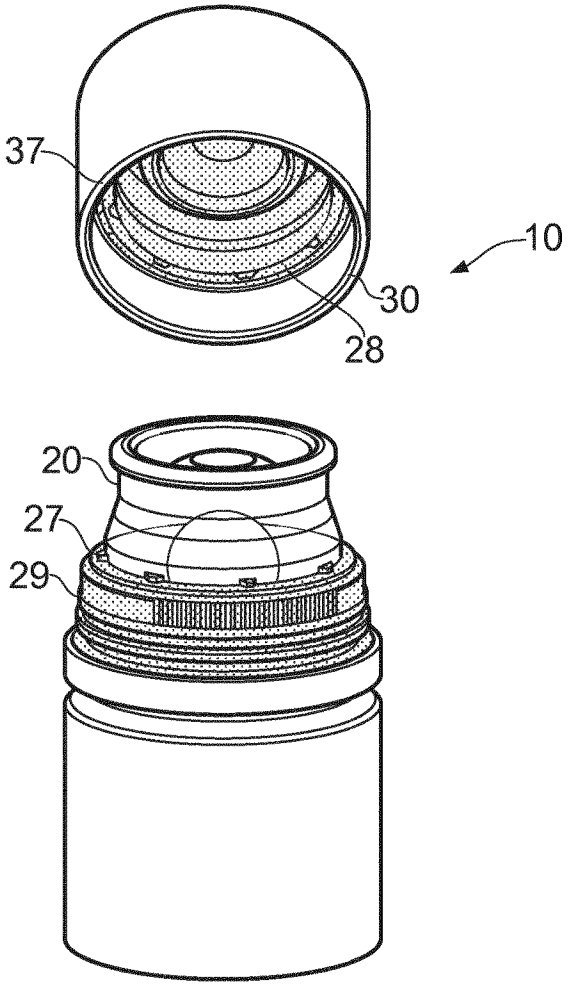
FIG. 8 is a perspective view of the closure of FIG. 7.
Figure 7:
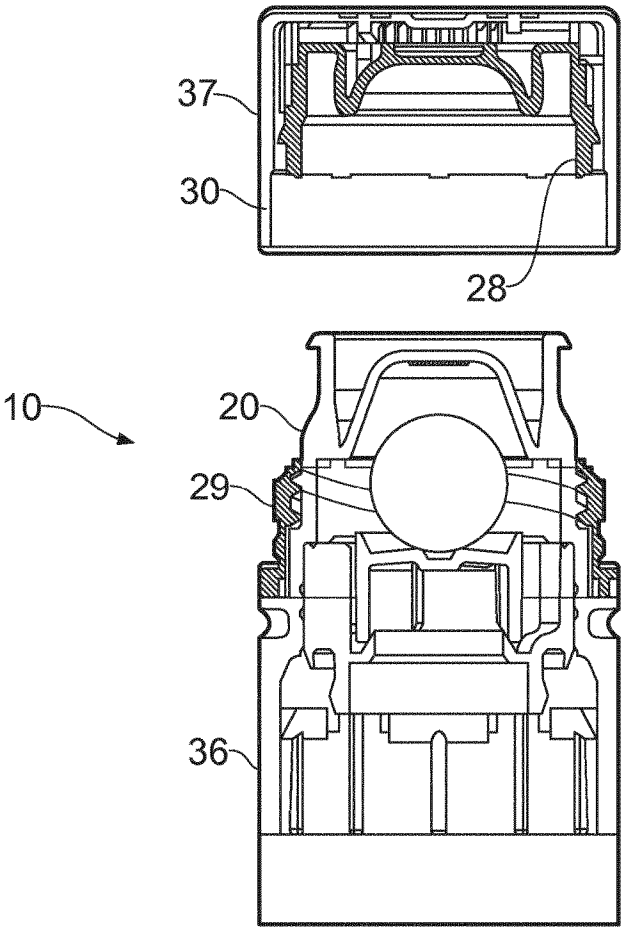
FIG. 7 shows the closure of FIG. 1 following an attempt at reverse opening.

In FIGS. 7 and 8 the closure of FIGS. 1 and 2 is shown following an attempt to overcome the tamper evidence by reverse opening.

If the shell part 37 is rotated clockwise the inner part first portion 28 is caused to rotate relative the second portion 29, which causes the bridges 27 to break. The inner part 25 splits along the line 26 and the shell part can be removed with the outer part and the inner part first portion. In other words, if the closure is deliberately (or accidentally) rotated in the direction opposition to that required for normal operation, in which the gap is generated, then the inner part is caused to break so that thereafter normal operation of the closure is not possible.

There are no internal screw threads on the first portion 28 so the top cap cannot be screwed back on the main body 20.

The break will occur if reverse opening is attempted (deliberately or accidentally) either before or after the gap is generated.

Other gap generation mechanisms are possible in conjunction with the stopper feature of the present invention.

Figure 9:
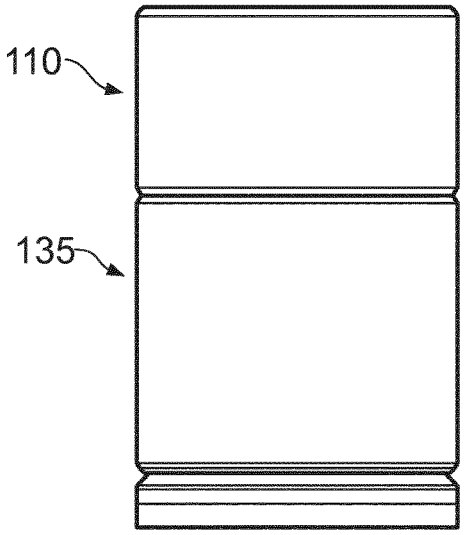
FIG. 9 is a side elevation of a closure formed according to the present invention.
Figure 10:
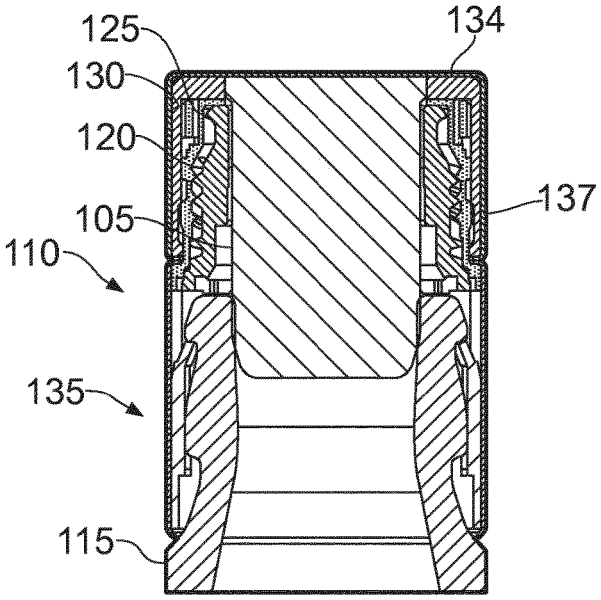
FIG. 10 is a section of the closure of FIG. 9.

Referring now to FIGS. 9 and 10 there is shown a closure 110 formed according to the present invention.

The closure 110 is similar to the closure 10 shown in FIGS. 1-8. Accordingly, an outer shell 135 houses a pourer body 120 and inner 125 and outer parts 130.

In this embodiment the pourer 120 is a through bore leading directly to the container neck 115 (as opposed to the pourer body 20 which includes a flow regulation feature). In addition, a generally cylindrical stopper 105 is provided on the top cap component, in this embodiment depending from the top plate 134 of the upper shell part 137. In FIG. 10 the stopper 105 is shown to extend through the bore of the pourer 120 and into the mouth of the neck 115 so as to seal the contents of the container.

Figure 12:
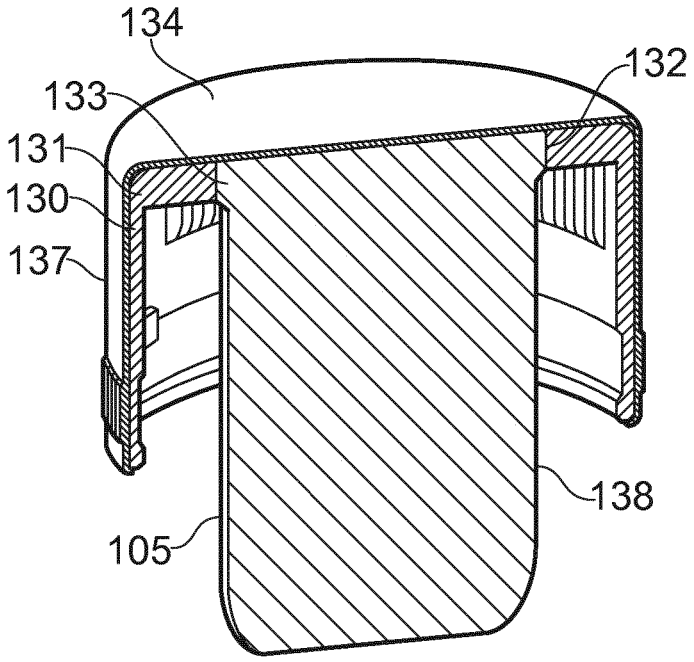
FIG. 12 is a perspective section view of a top cap component of the closure of FIGS. 9 to 11.

In FIG. 12 the stopper 105 is shown forming part of the top cap and extending from the shell top plate 134 and through the top plate 130 of the outer part 130. The inner part 125 is not shown for clarity. The top plate 131 of the outer part 130 is formed with a central opening 132 for receiving the head 133 of the stopper, with the stopper shank 138 extending away from the head. In some embodiments the outer part may comprise a holding feature (such as a rib or clip) for locating the stopper. The outer part and stopper can then together be assembled into the shell and, for example, secured using adhesive.

Figure 11:
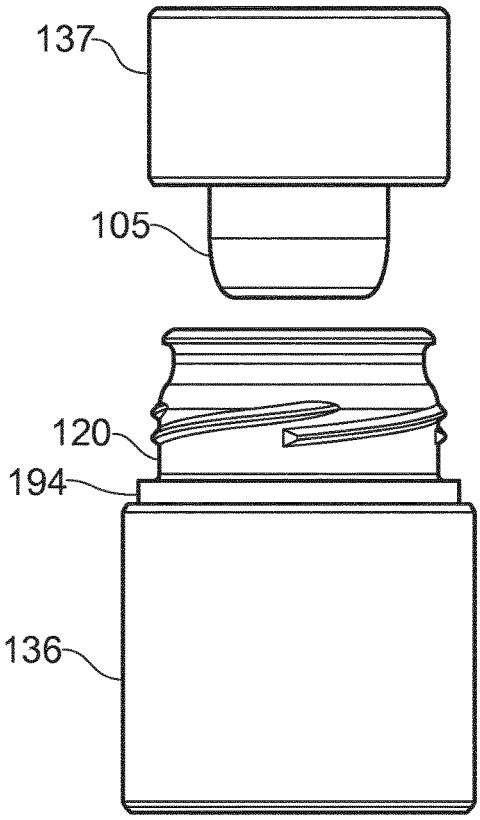
FIG. 11 is a side elevation of the closure of FIGS. 9 and 10 shown following an opening event.
Figure 13:
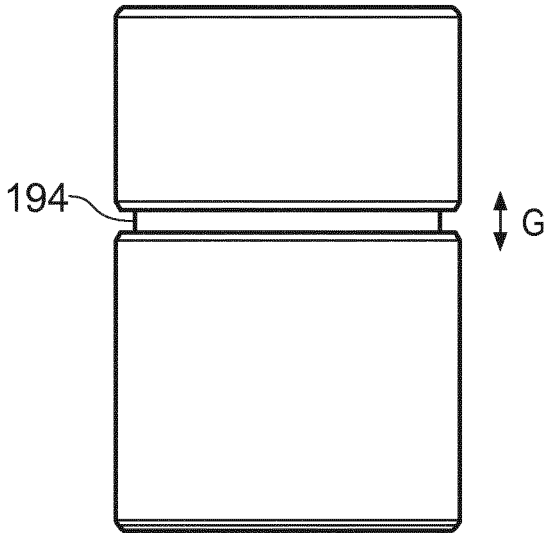
FIG. 13 is a side elevation of the closure of FIG. 11 when re-closed.

In use, the top cap, including the stopper 105 is grasped and turned. This activates the gap generation mechanism already described in relation to FIGS. 1-8 so that the cap can be removed as shown in FIG. 11. When the cap is subsequently replaced the gap G is generated and the band 194 of the inner part 125 projects so as to be visible in the gap, as shown in FIG. 13. In this position the stopper 105 has re-engaged into the mouth of the neck 115. Because the stopper 105 is formed from a compressible material, such as cork, an effective seal of the contents of the container is provided.

Other gap generator mechanisms may be used in conjunction with the compressible stopper feature, for example a mechanism as described in U.S. Pat. No. 5,738,231, WO 2005/049443 or WO 2006/117505.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A tamper-evident closure for a container, the tamper-evident closure comprising:

a first portion including inner and outer parts; and a second portion;

the outer part is rotatable relative to the inner part in a first direction from a first position in which at least parts of the first and second portions are adjacent each other to a second position in which there is a gap therebetween, the first portion comprising a locking means for irreversibly locking the outer part in the second position to the inner part upon first opening so that the gap cannot be closed, in which the first portion including the inner and outer parts locked together is removable and the first portion comprises a compressible stopper for sealing at least one of the second portion and the container.

2. The tamper-evident closure as claimed in claim 1, in which the second portion incorporates a pourer.

3. The tamper-evident closure as claimed in claim 1, in which the tamper-evident closure further comprises an outer shell.

4. The tamper-evident closure as claimed in claim 1, in which the compressible stopper is formed from cork.

5. The tamper-evident closure as claimed in claim 1, in which the compressible stopper is formed from a synthetic cork material.

6. The tamper-evident closure as claimed in claim 1, in which the locking means comprise a ratchet locking mechanism.

7. The tamper-evident closure as claimed in claim 1, in which the second portion is adapted to be connected to the container and the first portion comprises a cap.

8. The tamper-evident closure as claimed in claim 1, in which the tamper-evident closure further comprises a non-return fitment.

9. The tamper-evident closure as claimed in claim 1, in which the tamper-evident closure includes means for preventing the inner part from moving relative to the second portion until it has reached the second position.

10. The tamper-evident closure as claimed in claim 1, in which the gap is unobstructed.

11. The tamper-evident closure as claimed in claim 1, in which the gap is formed at respective adjacent peripheries of the first and second portions.

12. The tamper-evident closure as claimed in claim 1, in which the tamper-evident closure includes a metal shell.

13. The tamper-evident closure as claimed in claim 12, in which the shell is associated with the first and second portions and in which the gap is formed within the shell.

14. The tamper-evident closure as claimed in claim 1, in which the inner part includes a line of weakness which breaks if the outer part is rotated relative to the inner part in a second reverse direction, opposite the first direction.

15. The tamper-evident closure as claimed in claim 1, in which the compressible stopper extends through the second portion and into a bore of a container neck.

16. The tamper-evident closure as claimed in claim 1, in which the first portion includes a top plate and the compressible stopper depends from the top plate.

17. The tamper-evident closure as claimed in claim 1, in which the compressible stopper extends into at least one of the inner part and the outer part of the first portion.

18. The tamper-evident closure as claimed in claim 1 in combination with the container.

* * * * *